United States Patent [19]

Fox et al.

[11] Patent Number: 4,833,729

[45] Date of Patent: May 30, 1989

[54] SHARK PROTECTOR SUIT

[76] Inventors: Nelson C. Fox; Rosetta H. V. G. Fox, both of Ferry Reach, Anchorage View, St. Georges, Bermuda

[21] Appl. No.: 711,280

[22] Filed: Mar. 13, 1985

[51] Int. Cl.[4] ..... A62B 17/00; A41H 1/02; A41D 1/06

[52] U.S. Cl. ..... 2/2.1 R; 2/2.5; 2/70; 2/79; 2/69

[58] Field of Search ..... 2/67, 70, 2.1 R, 2, 2/69, 160, 161, 16, 79, 46, 2.5, 22

[56] References Cited

U.S. PATENT DOCUMENTS

| | | | |
|---|---|---|---|
| 463,477 | 11/1891 | Boucher et al. | 2/2.1 R |
| 1,102,772 | 7/1914 | Lyman | 2/2.1 R X |
| 1,289,839 | 12/1918 | Lowy | 2/2.1 R X |
| 1,813,965 | 7/1931 | Sferrazza | 2/67 X |
| 2,749,551 | 6/1956 | Garbellano | 2/2.1 R |
| 2,981,954 | 5/1961 | Garbellano | 2/2.1 R |
| 3,138,155 | 6/1964 | Bould | 2/2.1 R X |
| 3,835,470 | 9/1974 | Greiter | 2/79 |
| 4,055,174 | 10/1977 | LeVasseur | 2/2.1 R X |
| 4,356,569 | 11/1982 | Sullivan | 2/2.5 |

FOREIGN PATENT DOCUMENTS

| | | | |
|---|---|---|---|
| 1011502 | 7/1977 | Canada | 2/163 |
| 905234 | 3/1954 | Fed. Rep. of Germany | 2/161 |

*Primary Examiner*—H. Hampton Hunter

*Attorney, Agent, or Firm*—Berman, Aisenberg & Platt

[57] ABSTRACT

A shark protector suit of the invention is a combined rubber suit and helmet to completely cover the body of the wearer, including a face mask for facial protection, and preferably having at least a partial lining of flotation material, such as foam sheet. The suit and helmet have a plurality of spikes extending outward therefrom to prevent a shark from clamping its jaws over the wearer.

12 Claims, 4 Drawing Sheets

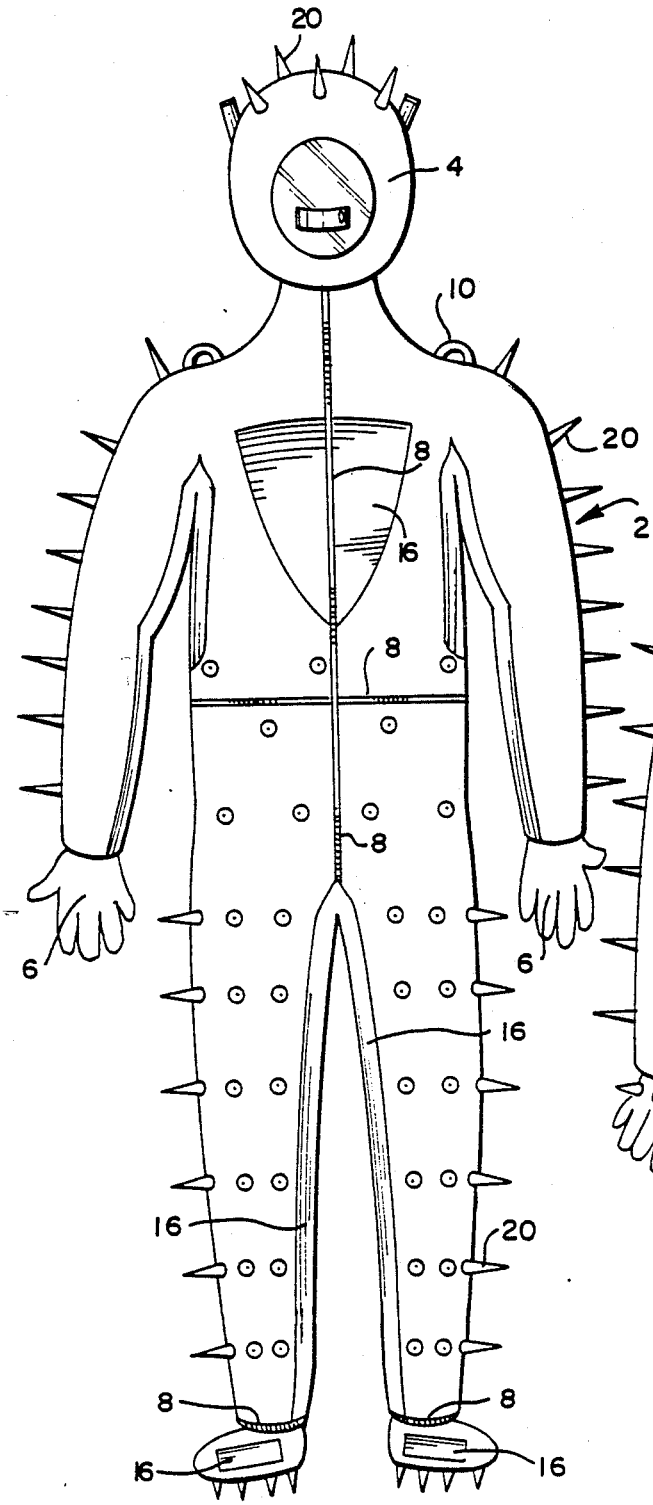
FIG. 1
FIG. 2
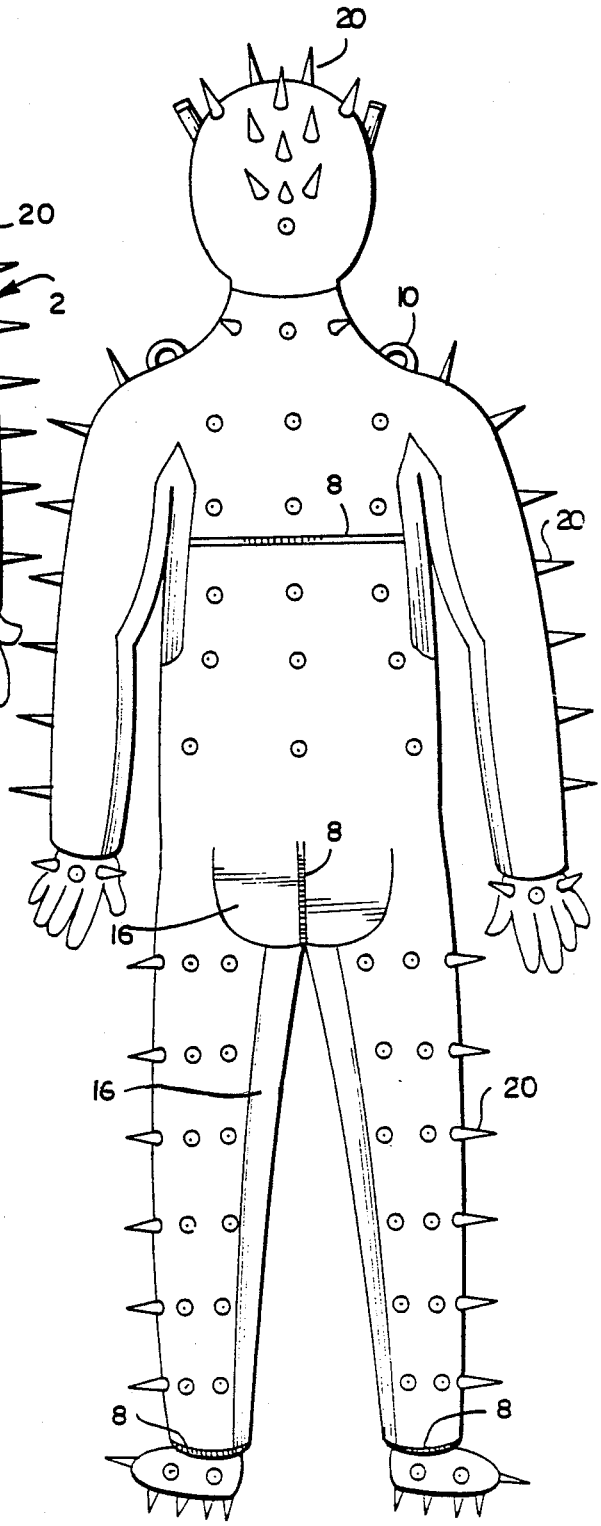

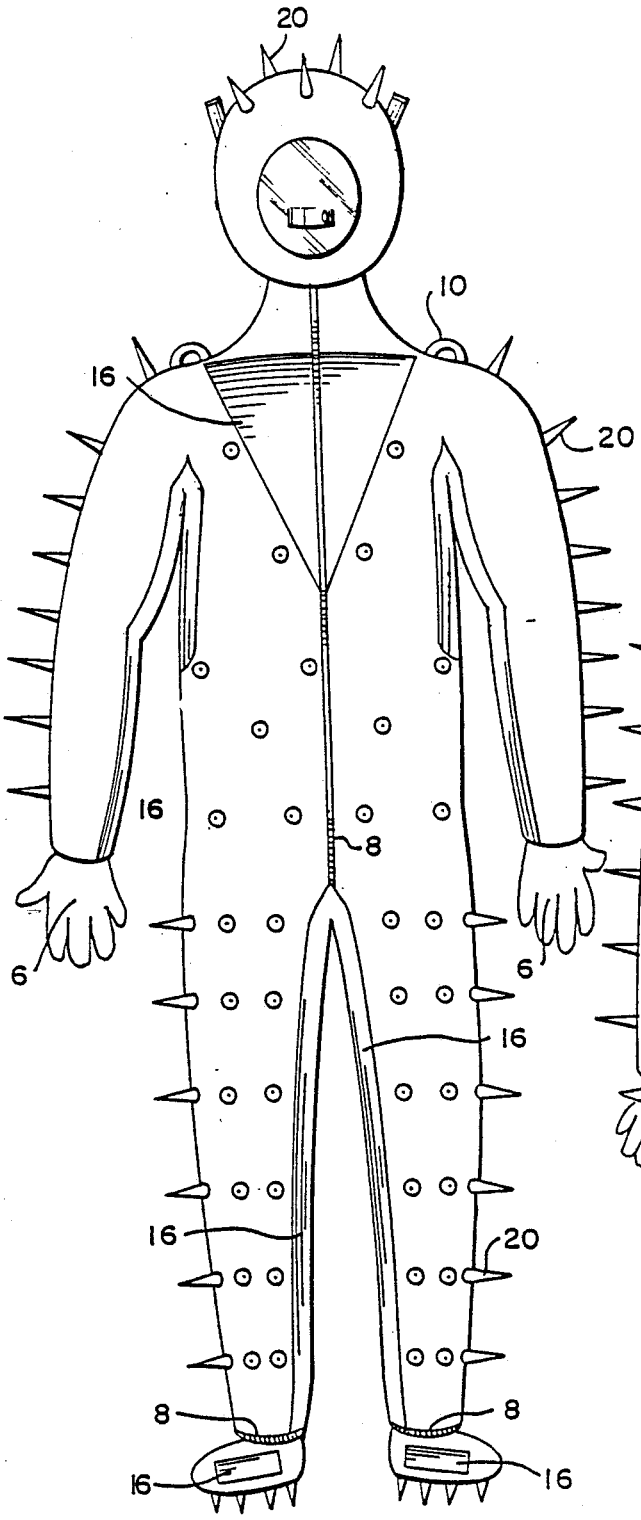
FIG. 3
FIG. 4
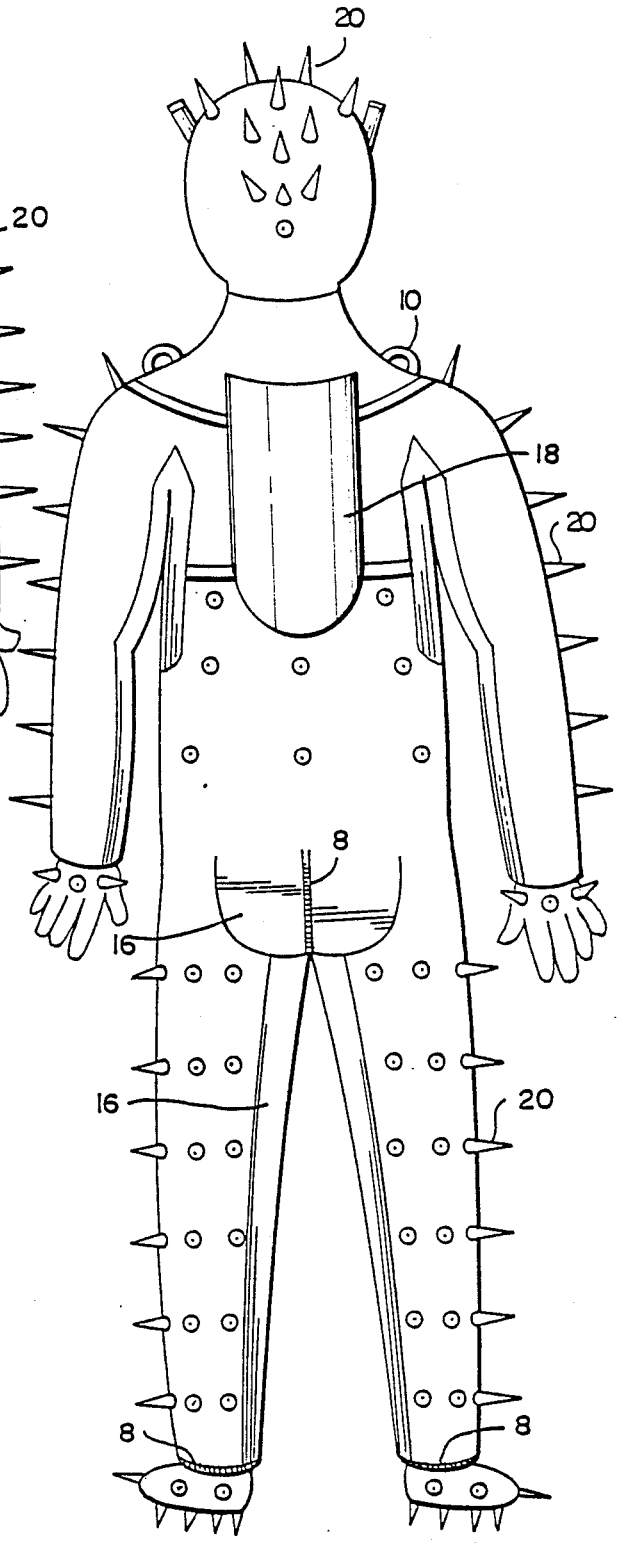

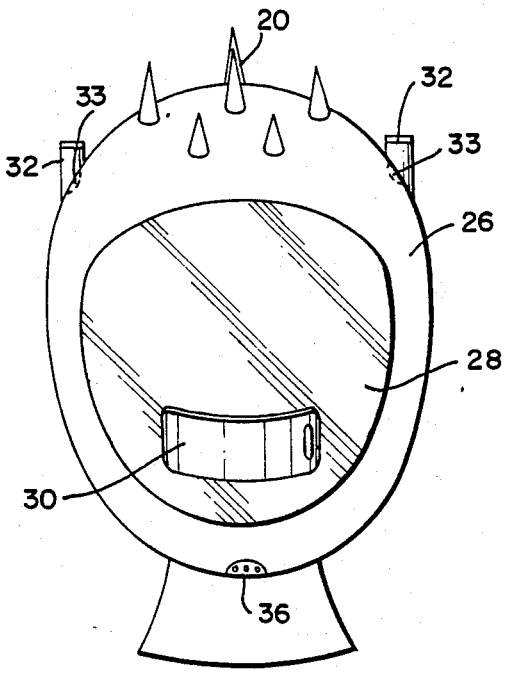
FIG. 8
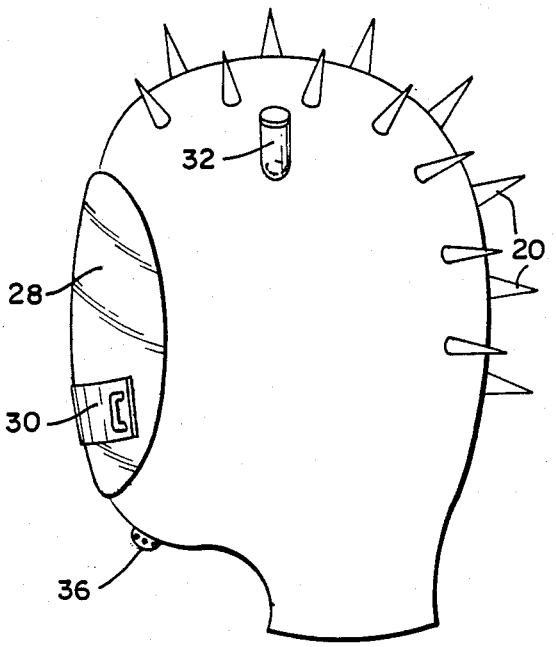
FIG. 9
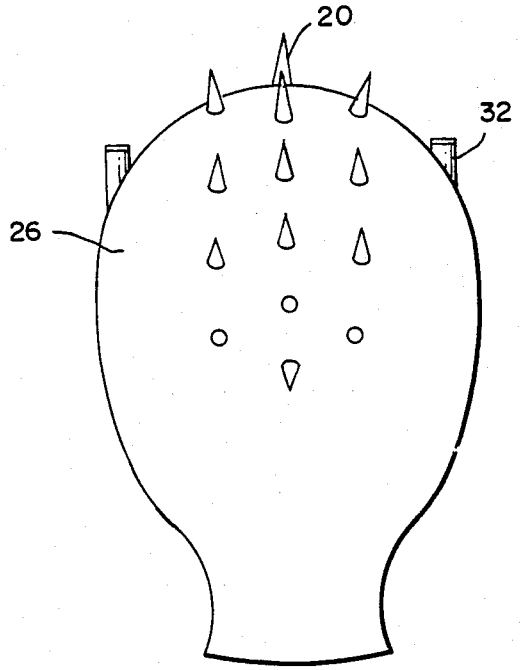
FIG. 11
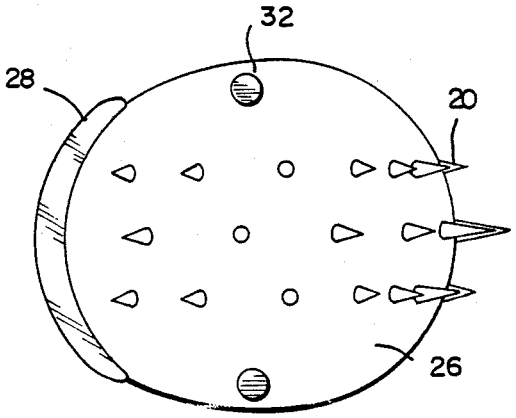
FIG. 10
FIG. 12
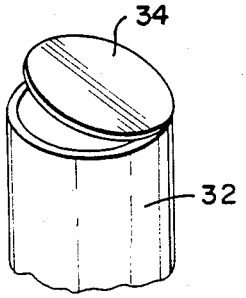

SHARK PROTECTOR SUIT

FIELD OF THE INVENTION

This invention relates to body protection suits for wearing in shark-infested waters.

BACKGROUND OF THE INVENTION

Known shark protection and underwater suits have not provided sufficient deterrence to sharks, since sharks are able to clamp their mouths around the limb of a person in the water.

SUMMARY OF THE INVENTION

A shark protector suit of the invention is a combined rubber suit and helmet to completely cover the body of the wearer, including a face mask for facial protection, and preferably having at least a partial lining of flotation material, such as foam sheet. The suit and helmet have a plurality of spikes extending outward therefrom to prevent a shark from clamping its jaws over the wearer.

An object of the invention is to provide an effective shark protection suit.

BRIEF DESCRIPTION OF THE DRAWINGS

FIG. 1 is a front elevational view of a shark protection suit of the invention.

FIG. 2 is a back elevational view of the suit of FIG. 1.

FIG. 3 is a front elevational view of another suit of the invention.

FIG. 4 is a back elevational view of the suit of FIG. 3.

FIG. 8 is a front elevational view of the helmet portion of the shark protector suit.

FIG. 9 is a side elevational view of the helmet portion of FIG. 8.

FIG. 10 is a top view of the helmet portion of FIG. 8.

FIG. 11 is a back elevational view of the helmet portion of FIG. 8.

FIG. 12 is a perspective view of the top flap of the breathing devices shown in FIGS. 8 to 11.

DETAILED DESCRIPTION OF THE INVENTION

Figure 5:
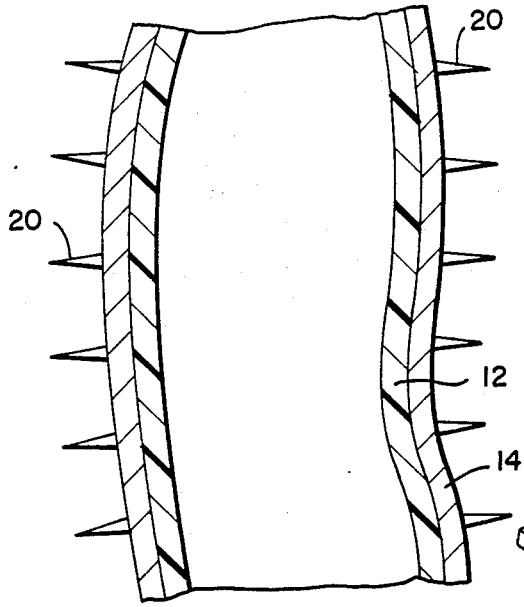
FIG. 5 is a cross-sectional view of the body portion of a suit of FIG. 1 showing the flotation lining of the suit.

The shark protection suit of the invention, which includes an attached helmet portion, has the unexpected advantage that a shark is unable to clamp its jaws around any part of the wearer since the multiplicity of spikes extending outwardly from the suit prevent the shark from closing its mouth, should it try to attack a wearer of the suit and helmet of the invention.

With reference to the Figures, in which like numerals represent like parts, FIGS. 1 and 2 show shark protector suit 2 having attached helmet 4, gloves 6 and shoes 8. Each of these parts of the suit is preferably made primarily of rubber or rubber-like material. The garment is put on and watertightly secured with zip fasteners 8 or other fasteners known in the art. FIGS. 1 and 2 show a plurality of zip fasteners 8 extending around the waist, at the ankles, from neck to waist, waist to crotch and through the seat of the suit. FIGS. 3 and 4 show an alternative arrangement of zip fasteners. Other means of watertight fastening and arrangement of fasteners will be apparent to one skilled in the art.

Suit 2 of the invention has loops 10 on the shoulders for attaching to a life raft, seaman's pillow (such as is shown in our patent, U.S. Pat. No. 4,666,414), or other flotation device. Optionally, suit 2 may include a layer of foam material 12 under at least a part of the outer layer 14 of the suit, as shown in FIG. 5.

Metal plates 16 are attached to portions of the suit where additional protection may be needed. Plates 16, which may alternatively be of other rigid protective material, are positioned, for example, on the front of the chest of the suit, on the inside of the arms, on the sides of the body, on the insides of the legs, in the seat area, and on the gloves and shoes.

Oxygen equipment 18 may be engaged on the back of suit 2 for underwater use.

Figure 6:
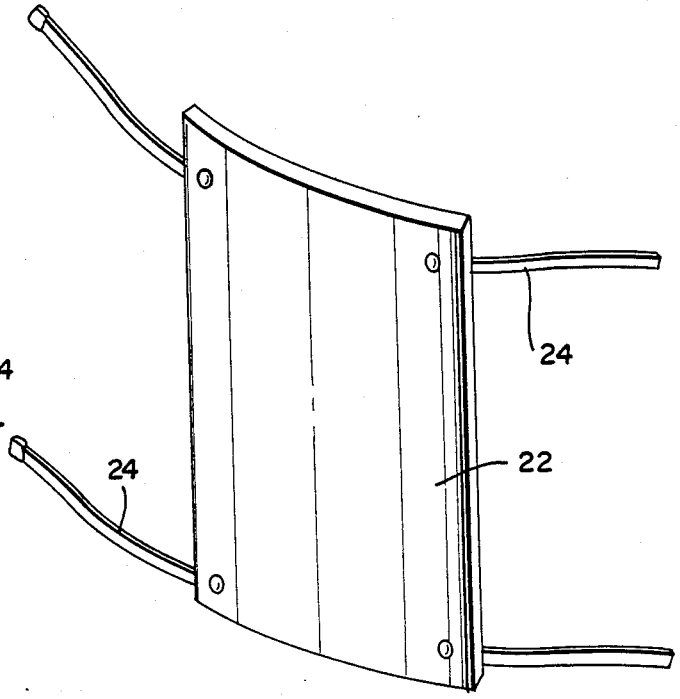
FIG. 6 is a schematic outside front view of a spike protection for covering the chest portion of the suit when not in use.
Figure 7:
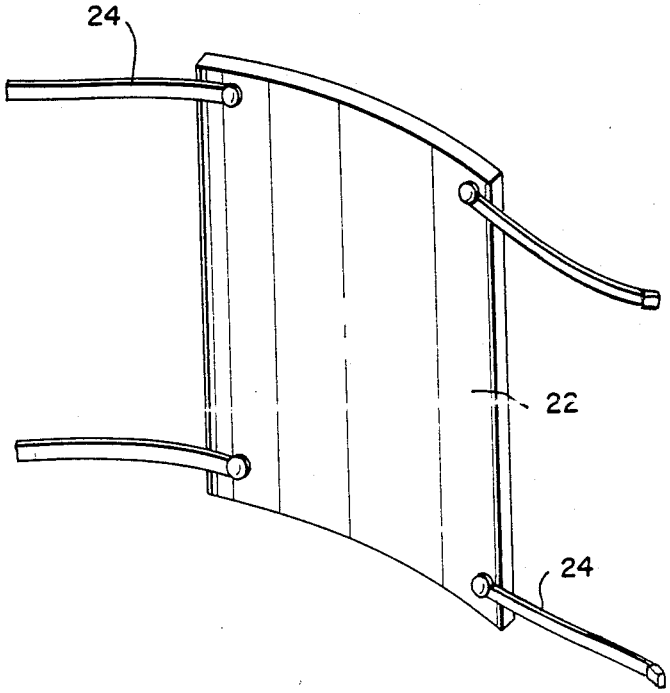
FIG. 7 is a schematic inside view of the spike protector of FIG. 6.

Spikes 20 extend outward from substantially any portion of the suit, for example, from the helmet, front, back, arm, leg, glove and shoe portions, as shown in FIGS. 1 to 5 and 8 to 11. FIGS. 6 and 7 show inside and outside views of spike protectors 22 which may be secured by tapes 24 over spikes on the suit, particularly when not in use, for protection.

Helmet portion 26, shown in FIGS. 8 to 11, which may include a thin layer of foam flotation material, has visor portion 28 transparently and watertightly covering the face. Portion 30, covering the mouth, may be opened and closed watertightly, as necessary. Portion 30 is closed against a rubber seal. Tiny drain holes 36 in the chin portion vent excess moisture.

Breathing apparatus having tubular portion 32 has a ball swivel 33 at the base of the tubular portion, for facilitating watertight breathing, as shown schematically in FIG. 8. FIG. 12 shows rubber flap 34 engaging upper end of breathing apparatus 32 to provide a watertight closure.

While the invention has been described above with respect to certain embodiments thereof, it willl be appreciated that variations and modifications may be made without department from the spirit and scope of the invention.

We claim:

1. A suit for protecting its wearer from attack by sharks comprising:

rubber suit means for substantially completely covering the wearer's body;

closed helmet means including a face mask attached to the suit means for substantially completely covering the wearer's head;

glove means attached to the suit means for substantially completely covering the wearer's hands;

shoe means attached to the suit means for substantially completely covering the wearer's feet;

elongated spike means for repelling sharks extending outwardly from the suit means and helmet means; and rigid plate means attached to an outer surface of the suit for protecting the wearer.

2. A suit of claim 1 further comprising flotation means for facilitating floating.

3. A suit of claim 2 wherein the flotation means comprises a layer of foamed material lining at least part of the suit means.

4. A suit of claim 1 wherein the helmet means further comprises vent means for facilitating breathing.

5. A suit of claim 1 further comprising fastener means for facilitating putting on and taking off the suit.

6. A suit of claim 1 further comprising attachment means for attaching to auxiliary flotation devices.

7. A suit of claim 1 further comprising tank means for providing oxygen, engaged with the suit.

8. A suit of claim 1 wherein the plate means is attached to a front chest portion of the suit.

9. A suit of claim 1 wherein the plate means is attached to inner side leg portions of the suit.

10. A suit of claim 1 wherein the plate means is attached to outer side body portions of the suit between the underarm and hip of the wearer.

11. A suit of claim 1 wherein the plate means is attached to inner side portions the shoe means.

12. A suit of claim 1 wherein the spike means extends outward from a plurality of the chest, back, leg, glove, shoe and helmet portions of the suit.

* * * * *